US005394611A

United States Patent [19]

Okabe et al.

[11] Patent Number: 5,394,611

[45] Date of Patent: Mar. 7, 1995

[54] ELECTRIC RAZOR

[75] Inventors: Masaki Okabe; Tsuyoshi Nakano, both of Nagano, Japan

[73] Assignee: Izumi Products Company, Nagano, Japan

[21] Appl. No.: 163,378

[22] Filed: Dec. 7, 1993

[30] Foreign Application Priority Data

Jan. 8, 1993 [JP] Japan ..... 5-018230

[51] Int. Cl.[6] ..... B26B 19/16

[52] U.S. Cl. ..... 30/43.6; 30/41.6

[58] Field of Search ..... 30/41, 41.6, 43, 43.4, 30/43.5, 43.6, 133, 347

[56] References Cited

U.S. PATENT DOCUMENTS 4,137,629 2/1979 Yamazaki ..... 30/43.5
4,222,168 9/1980 Boiten et al. ..... 30/43.6
4,347,662 9/1982 Tietjens ..... 30/43.6
4,475,285 10/1984 Hara et al. ..... 30/43.6
4,839,964 6/1989 Uchiyama et al. ..... 30/43.6
4,847,996 7/1989 Blykharov ..... 30/43.6
4,899,442 2/1990 Horii et al. ..... 30/133

*Primary Examiner*—Richard K. Seidel
*Assistant Examiner*—Hwei-Siu Payer
*Attorney, Agent, or Firm*—Koda and Androlia

[57] ABSTRACT

An electric razor with a fan assembly installed under and coaxially with a rotary inner cutter. The whiskers entering through slits of an outer cutter are cut by the inner and outer cutters, and the sheared whiskers are blown by the fans of the fan assembly and collected in a receptacle element provided in the razor. Thus, the shaving debris does not stick to the inner and outer cutters, making it easy to clean the razor.

7 Claims, 4 Drawing Sheets

ELECTRIC RAZOR

BACKGROUND OF THE INVENTION

1. Field of the Invention

The present invention relates to an electric razor and more particularly to an electric rotary razor.

2. Prior Art

In rotary electric razors, the inner cutters are rotated under the outer cutters, and the whiskers are cut by the shearing force provided by the outer and inner cutters. There is an electric razor having a single shaving unit that consists of a single inner cutter and a single outer cutter installed in a head frame of a razor. There is also another type of electric razor that has three shaving units arranged in an equilateral triangle shape on a head frame.

When shaving is performed, shaving debris or sheared whiskers cut by the cutters is mixed with grease secreted out of the skin and adhere to the shaving units and other razor components. Thus, it becomes necessary to clean the shaving units. However, the cleaning of the shaving unit is difficult due to its structure. This problem is especially conspicuous in electric razors includes a plurality of (or three) shaving units. In such razors, the shaving units must be individually cleaned. The cleaning process is thus more troublesome.

SUMMARY OF THE INVENTION

Accordingly, the primary object of the present invention is to provide an electric razor that can collect the shaving debris in a receptacle provided under the shaving units so that the shaving debris is kept away from the shaving units so as to not adhere to the shaving units, thus keeping the shaving unit clean.

In order to solve the problems, the electric razor of the present invention uses fans so that the shaving debris is blown and prevented from sticking to the shaving units and other razor components.

More specifically, the present invention is for an electric razor that includes a drive shaft holder of a cylindrical receptacle shape installed in a razor housing, a detachable head frame fitted on the razor housing so as to cover the drive shaft holder, shaving units installed under the head frame each of the shaving units consisting of an outer cutter having slits for introducing whiskers and an inner cutter rotatable on the back surface of the outer cutter for shearing the whiskers introduced via the slits, drive shafts connected to the inner cutters and linked to a driving source, and fans installed coaxially with the inner cutters and rotated together with the inner cutters by the driving force of the drive shafts.

In the above structure, fans are obtained by a fan assembly. The fan assembly is made up of a cylindrical base body, an engagement hole formed in the bottom, at least one fan blade provided on the circumferential surface of the cylindrical base body to extend in the radial direction, and an engagement projection provided on the top surface of the base body. The fan assembly is installed between the inner cutter and the drive shaft that rotates together with the inner cutter.

It is preferable to design each of the inner cutters to have a plurality of arms that are bent upwardly from the outer edge of the inner cutter and formed with cutting blades at the ends of the arms so that cutting edges of the cutting blades can slide on the back surface of the outer cutter. The cutting blades are inclined in a rotational direction of the inner cutter.

In addition, the fan blades of the fan assembly are also inclined so as to be somewhat continuous to the cutting blades of the inner cutter. The fan assembly may have fan blades that are positioned between the cutting blades of the inner cutters. In addition, the fan blades can be extended in the axial direction of the base block so that the upper edges are located immediately beneath the back surface of the outer cutter.

Moreover, the electric razor may have a supporting tube so that the supporting tube can support the outer cutter by pressing it from inside the razor. In this case, the inner cutter and the fan assembly are positioned inside the supporting tube.

With the above described structure, the whiskers penetrating the outer cutters through the slits thereof are sheared by the outer cutters and inner cutters, and these sheared whiskers are blown downward (as if being sucked in) by the fan blades which rotate together with the inner cutters. Thus, the sheared whiskers are collected in the drive shaft holder which is a cylindrical receptacle shape. The inner cutter and the fan assembly are provided inside the supporting tube which support the outer cutter. Accordingly, the supporting tube act as a guide for the whiskers dropping into the drive shaft holder without being scattered.

DETAILED DESCRIPTION OF THE INVENTION

A preferred embodiment of the present invention will be described below in detail with reference to the accompanying drawings.

Figure 1:
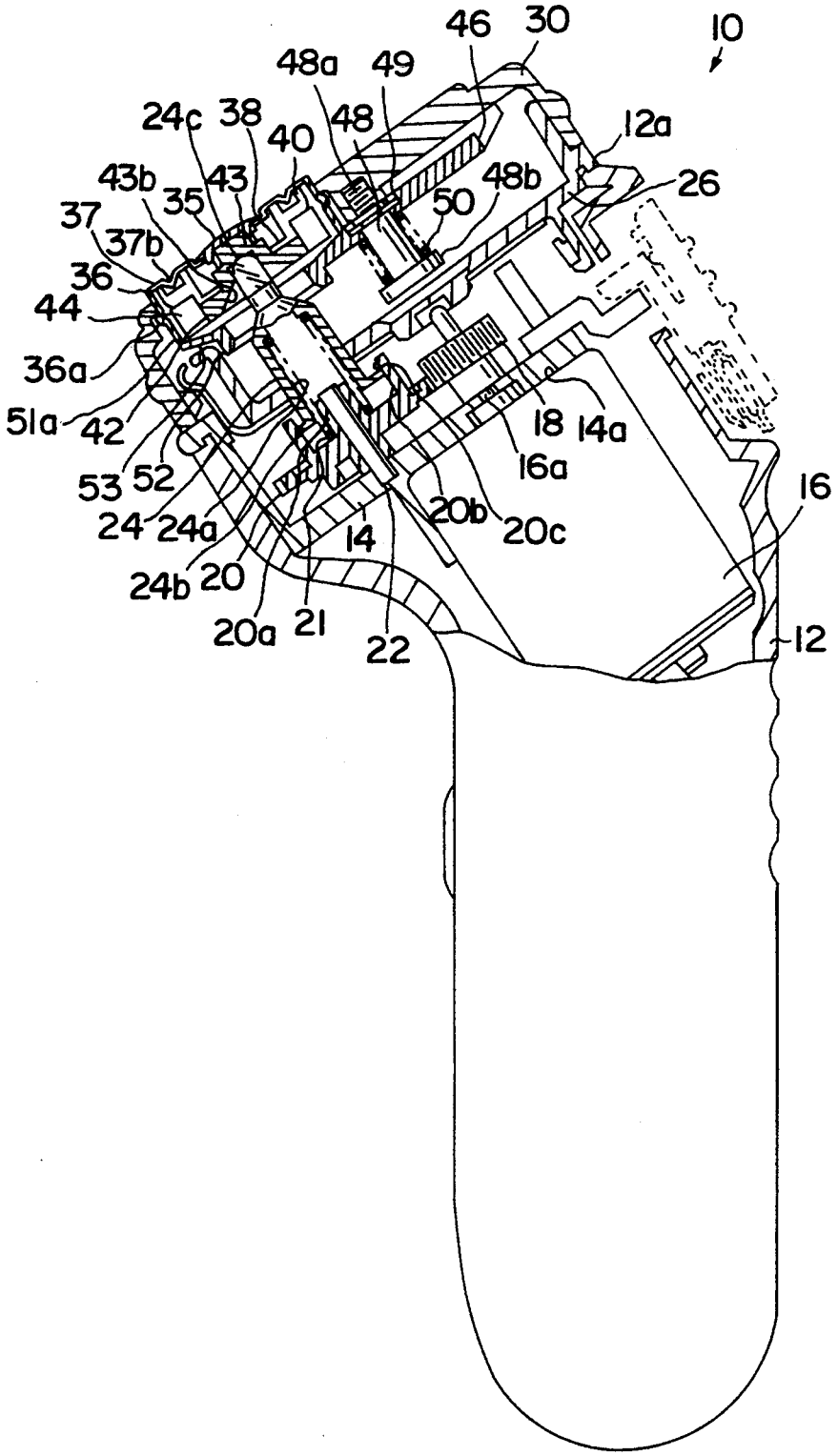
FIG. 1 is a cross-sectional view of the head portion of the electric razor according to the present invention.

In FIG. 1, reference numeral 12 is the housing of an electric razor 10. The housing 12 has an opening **12*a* at the upper end, and a fixing frame 14 is inserted into the housing 12 through this opening 12*a* and fixed inside the housing 12. A motor 16 is mounted to the undersurface of the fixing frame 14. The axle 16*a* of the motor 16 protrudes through a hole 14*a* of the fixing frame 14, and a drive gear 18 is coupled to the motor axle 16*a***.

Three transmission gears 20 (only one is shown) are rotatably provided on the fixing frame 14 and engaged with the drive gear 18. These transmission gears 20 are arranged in an equilateral triangle configuration, and drive shafts 24 (only one is shown) are engaged with the transmission gears 20. Since all three transmission gears 20 have the same structure, only one transmission gear 20 and its related elements will be described below.

The transmission gear 20 includes a shaft tube **20*a* which is rotatable on a shaft 22 that is fixed to the fixing frame 14. A coil spring 21** is provided on the shaft tube 20*a*. The lower portion of the spring 21 is positioned on the shaft tube 20*a*, and the upper portion of the spring 21 is set inside the inner tube 24*a* of the drive shaft 24. Thus, the drive shaft 24 is urged upward (in the drawing) by the spring 21. A flange 24*b* is formed around the lower end of the drive shaft 24 and positioned inside a guide tube 20*b* of the transmission gear 20. The drive shaft 24 is prevented from slipping relative to the transmission gear 20 by a claw 20*c* formed on the inner surface of the guide tube 20*b*. The flange 24*b* of the drive shaft 24 is engaged with the guide tube 20*b* so that the transmission gear 20 and the drive shaft 24 are rotated together. As an example of this engagement of the drive shaft 24 and the transmission gear 20, a portion of the flange 24*b* of the drive shaft 24 has a cut away portion, and the guide tube 20*b* has the same shape as the cut-away flange 24*b* for a secure engagement.

A drive shaft holder 26 is installed in the opening 12*a* of the housing 12 at a distance from the fixing frame 14. The drive shaft holder 26 is shaped in somewhat a shallow cylindrical receptacle. The upper portion of the drive shaft 24 protrudes from the bottom of this drive shaft holder 26.

Figure 2:
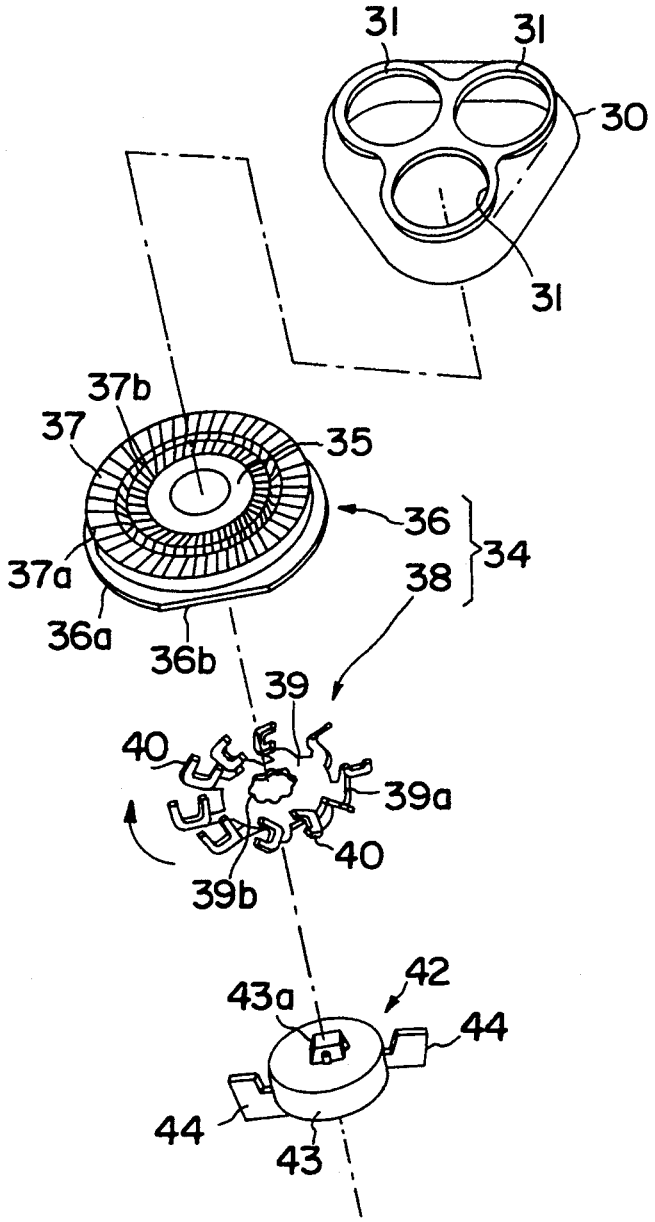
FIG. 2 shows a disassembled shaving unit together with a head frame and a fan assembly used in the razor.

A head frame 30 is detachably fitted on the housing 12 so that the head frame 30 covers the drive shaft holder 26. As seen in FIG. 2, three through holes 31 are opened in the head frame 30 so that three shaving units described below are installed in these holes 31 from the inside of the housing 12.

Each shaving unit 34 comprises an outer cutter 36 and an inner cutter 38. The outer cutter 36, as seen in FIG. 2, has a round shaving surface 37 on its top surface. Radial slits 37*a* are opened for the entire shaving surface 37. An outer cutter cap 35 is fitted in the center of the outer cutter 36. A ring-shaped guide groove 37*b* is formed at an intermediate point of the shaving surface 37, so that the shaving surface 37 is divided into two (outside and inside) sections in the form of concentric circles. The outer cutter 36 has a flange 36*a* at the lower end. The flange 36a comes into contact with the inside surface of the head frame 30 so that the outer cutter 36 cannot slip off. In addition, a cut-out 36*b* is formed at one part of the outer cutter 36. Thus, the outer cutter 36 is prevented from rotating by a combination of the cut-out 36*b* and a stopper (not shown) formed on the inside surface of the head frame 30.

On the other hand, the inner cutter 38 has a plurality of arms 39*a* extended upwardly from the outer edge portion of a cutter disk 39, and cutting blades 40 are formed at the ends of these arms 39*a* so that they slide on the back surface of the outer cutter 36. The ends of these cutting blades 40 are split into two branches so that each of the split ends can fit in the two circular sections of the shaving surface 37 of the outer cutter 36. The cutting blades 40 are inclined in the direction of rotation of the inner cutter that is shown by an arrow in FIG. 2.

An engagement hole 39*b* is opened in the cutter disk 39 of the inner cutter 38. The engagement hole 39*b* is formed, for example, in a square shape with a semicircular cut-out formed on each side of the square hole 39*b*. Into this engagement hole 39*b* of the inner cutter 38, a portion of a fan assembly 42 is inserted to make a secure engagement between the inner cutter 38 and the fan assembly 42.

The fan assembly 42 is comprised of a base block 43, at least one fan blade 44 and an engagement projection 43*a*. The base block 43 is a shallow cylinder and the engagement projection 43*a* is formed on the top surface of this base block 43. The engagement projection 43*a* has the same shape as the engagement hole 39*b* of the inner cutter 38 so as to be snugly fitted into the engagement hole 39*b*. Furthermore, as seen in FIG. 1, an engagement hole 43*b* is formed in the bottom of the base block 43 so that a transmission tongue 24*c* formed at the tip end of the drive shaft 24 is inserted into this engagement hole 43*b*. The surrounding areas of the engagement hole 43*b* are rounded for an easy insertion of the transmission tongue 24*c* of the drive shaft 24 into the engagement hole 43*b*.

FIG. 2 shows the fan assembly 42 with two fan blades 44 that extend in a radial direction from the circumferential surface of the base block 43. These fan blades 44 are inclined in the same direction as the cutting blades 40 of the inner cutter 38, the direction of inclination of the fan blades being the rotational direction of the inner cutter 38 and the fan assembly 42.

Figure 3:
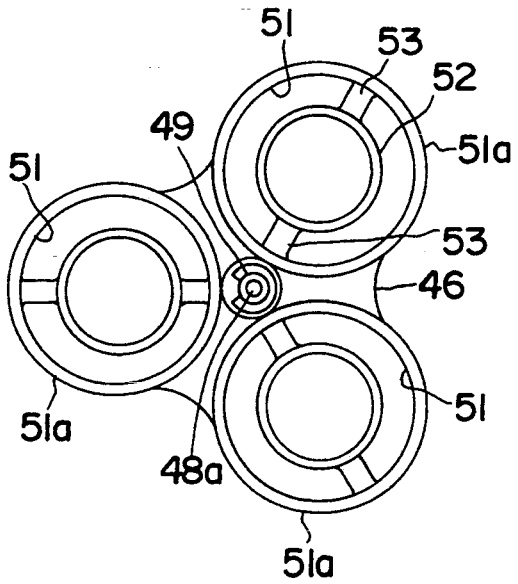
FIG. 3 is a top view of a shaving unit retaining plate used in the razor.
Figure 4:
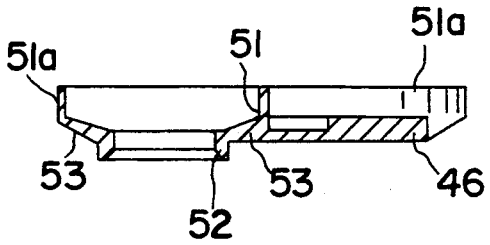
FIG. 4 is a cross section of the shaving unit retaining plate.

Back to FIG. 1, the reference numeral 46 is a shaving unit retaining plate 46, and it is installed on the back surface of the head frame 30. The shaving unit retaining plate 46 is fixed to the head frame 30 via a supporting shaft 48. The supporting shaft 48 has a threaded portion 48*a* that is screwed into the center hole of the head frame 30. The supporting shaft 48 has a flange 48*b* at the lower-end, and a spring 50 is installed on the supporting shaft 48 so that the spring 50 is between the flange 48*b* and the shaving unit retaining plate 46. The upper end of the supporting shaft 48 is restrained by a retaining ring 49. Thus, the shaving unit retaining plate 46 is urged upwardly (in the drawings) by the spring 50. In addition, as best seen in FIG. 3, the shaving unit retaining plate 46 has through holes 51 so as to positionally correspond to the holes 31 formed in the head frame 30. As seen in FIG. 1, supporting tubes 51*a* project upwardly from the inside rims of these holes 51, and the upper ends of these supporting tubes 51*a* are in contact with the flanges 36*a* of the outer cutters 36.

When shaving is performed, the shaving surfaces 37 of the outer cutters 36 are pressed toward the inside of the razor 10 so that the outer cutters 36 are pushed inwardly against the driving force of the springs 50. Thus, the shaving is performed with the razor snugly fitting the facial contour. Since the drive shafts 24 that hold the fan assembles 42 are also supported by springs 21, the drive shafts 24 can move to and fro in the axial directions together with the shaving units 34.

Meanwhile, the shaving unit retaining plate 46 has a ring section 52 in each supporting part 53. The ring section 52 is supported by the drive shaft 24 so as not to come into contact with the fan assembly 42 during the shaving. Also, the shaving unit retaining plate 46 is fixed to the back surface of the head frame 30 by the supporting shaft 48. Accordingly, when the head frame 30 is removed from the razor 10, the shaving units 34 and the fan assemblies 42 do not drop off of the shaving unit retaining plate 46 because of the ring sections 52 of the supporting tubes 51*a* of the shaving unit retaining plate 46.

In use, the electric razor 10 is switched on, and shaving is performed by pressing outer cutters 36 against the skin. Whiskers penetrating the outer cutters 36 through the radial slits 37*a* of the shaving surface 37 are sheared by the outer cutters 36 and the cutting blades 40 of the inner cutters 38 which are rotated by the motor 16 via the drive gear 18, the transmission gears 20 and the drive shafts 24. The sheared whiskers are driven downwardly while being sucked in by the fan blades 44 of the fan assemblies 42 which are rotating together with the inner cutters 38.

In this case, since the upper ends of the supporting tubes 51*a* are in contact with the flanges 36*a* of the outer cutters 36, the sheared whiskers are guided by the supporting tubes 51*a* and drop without being scattered or coming out of the outer cutters 36. The whiskers are collected in the receptacle shape drive shaft holder 26; and once the whiskers are in the drive shaft holder 26, they do not fly out through the slits 37*a* of the outer cutters 36.

When whiskers are collected in the drive shaft holder 26, the head frame 30 is detached and the whiskers are removed from the drive shaft holder 26 by a brush, etc. Since not much of the shaving debris sticks to the shaving units 34 because of the function of the fan assemblies 42, there is no great need to clean the shaving units 34. If, however, the shaving units 34 need to be cleaned, they can be removed from the head frame 30 by unscrewing the supporting shaft 48.

Figure 5:
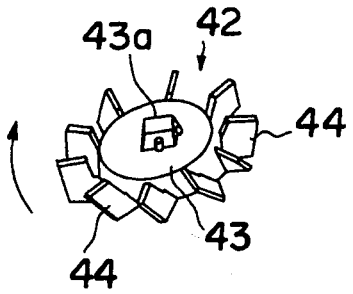
FIG. 5 shows a different type of fan assembly used in the razor.

FIG. 5 shows a modified fan assembly 42. This fan assembly 42 has ten fan blades 44 extending radially from the circumferential surface of the base block 43. The remaining structure of this fan assembly 42 is the same as the fan assembly shown in FIG. 2. Thus, the fan blades can be in any number. The arrow in FIG. 5 indicates the direction in which the fan assembly 42 is rotated.

Figure 6:
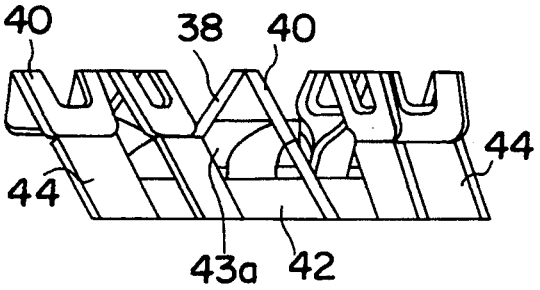
FIG. 6 is a side view of an arrangement of the inner cutter and the fan assembly.

FIG. 6 shows an arrangement of one of the inner cutters 38 with a fan assembly 42 which has a plurality of fan blades 44. The cutting blades 40 of the inner cutter 38 is the same in number as the fan blades 44 of the fan assembly 42. The cutting blades 40 and fan blades 44 are also designed so as to be at the same angle of inclination. Furthermore, the lower ends of the cutting blades 40 and the upper ends of the fan blades 44 are set to be in contact so that the cutting blades and the blades are flush and continuous to each other. However, the cutting blades 40 and the fan blades 44 can be positioned so that the surfaces thereof are not flush in the circumferential direction. In FIG. 6, the fan assembly 42 has ten fan blades 44; however, there is no particular restriction on the number of the fan blades 44.

Figure 7:
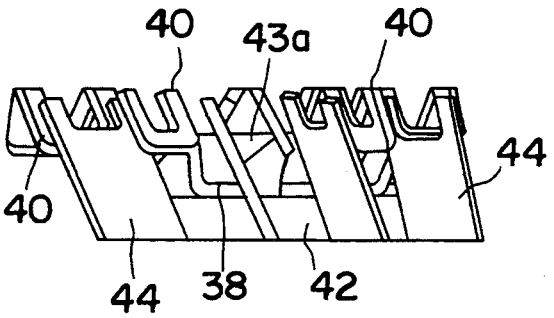
FIG. 7 is a side view of another type of arrangement of the inner cutter and the fan assembly.

FIG. 7 shows a modified arrangement of the inner cutter 38 and a fan assembly 42. The fan blades 44 of the fan assembly 42 are positioned between the cutting blades 40 of the inner cutter 38. The inclination of the fan blades 44 is set to be the same as that of the cutting blades 40. Furthermore, the fan blades 44 are extended in the axial direction of the base block 43 so that the upper edges of them can be located immediately beneath the back surface of the shaving surface of an outer cutter. In addition, the upper end of each fan blade is branched into two. With these fan blades, the branched upper ends of the fan blades can scrape off the shaving debris, if any, sticking to the back surfaces of the circularly divided shaving surface 37 of the outer cutter 36. In this case, the fan blades 44 can also be in any number.

In the embodiments described above, the inner cutters 38 and the fan assemblies 42 are coupled together via the engagement holes 39*b* opened in the inner cutters 38 and the engagement projections 43*a* formed on the fans 42. However, this engagement relationship can be reversed. It is also possible to use other engagement structures. Furthermore, in the embodiments described above, the inner cutters 38 are made out of metal, and the fans 42 a synthetic resin. However, the fan assemblies 42 and the inner cutters 38 can be made in a single unit form a single material. For example, an inner cutter 38 may have not only the cutting blades but also the fan blades.

As seem from the above, in the present invention, whiskers sheared by the shaving units 34 are blown in by the suction force of the fan assemblies 42. However, the concept of "fan" includes not only fan assemblies with fan blades but also other types of suction devices which are capable of providing a suction force, such as rotary helical elements.

Various aspects of an appropriate embodiment of the present invention are described above. However, the present invention is not limited to the embodiments. It goes without saying that various modifications are available within the spirit of the present invention.

As described in detail in the above, according to the electric razor of the present invention, whiskers cut by the outer cutters land inner cutters are scraped off and pulled by the suction force of the fans so that the whiskers are blown into and collected in a receptacle element which is the drive shaft holder in the embodiment. Accordingly, not much of the shaving debris adheres to the shaving units which are difficult to clean. Thus, cleaning of the electric razor is made easier. In addition, as a result of the rotation of the fan assemblies, the whiskers entering through the slits of the outer cutter are pulled into the razor body and extended. Thus, the cutting of the whiskers can be done more efficiently.

Furthermore, the outer cutters are supported from the inside of the razor housing by the supporting tubes, and the inner cutters and fan assembly are positioned inside these supporting tubes. Accordingly, the scattering of the shaving debris is prevented. In addition, the adhesion of shaving debris to the inside walls of the supporting tubes can be prevented by the rotation of the fan blades.

We claim:

1. An electric razor comprising:

a razor housing;

a head frame detachably fitted on said razor housing, said head frame having a plurality of through holes for outer cutters;

a fixing frame installed in said razor housing;

a motor mounted to said fixing frame and has a drive gear coupled to a rotary shaft of said motor;

a plurality of transmission gears rotatably mounted to said fixing frame and engaged with said drive gear of said motor;

a plurality of drive shafts engaged with said transmission gears;

a drive shaft holder installed in said razor housing and has a plurality of through holes so that said drive shafts project therethrough, said drive shaft holder being in a cylindrical receptacle shape;

a plurality of fan assemblies mounted to tip ends of said drive shafts, each one of said fan assemblies having at least one fan blade;

a plurality of inner cutters coaxially provided on said fan assemblies; and a plurality of outer cutters provided in said holes of said head frame so as to make shaving units together with said inner cutters.

2. An electric razor according to claim 1, further comprising a shaving unit retaining plate mounted to said head frame via a screw, said shaving unit retaining plate being provided with a plurality of supporting tubes that accommodate said shaving units.

3. An electric razor comprising: a head frame installed in a freely detachable manner on a drive shaft holder so that said head frame covers said drive shaft holder; shaving units installed on a back side of said head frame, each of said shaving units consisting of an outer cutter with slits for introducing whisker and an inner cutter which rotates on a back surface of said outer cutter to shear whiskers introduced through said slits; drive shafts projecting from said drive shaft holder so as to be connected to a driving source and coupled to said inner cutters, wherein fans are installed coaxially with said inner cutters so as to be rotated together with said inner cutters by a driving force from said drive shafts and each of said fans comprises: a base block, an engagement hole engageable with a corresponding drive shaft, fan blades extended in a radial direction from a circumferential surface of said base block, and an engagement projection formed on an upper surface of said base block so as to engage with a corresponding inner cutter.

4. An electric razor according to claim 2, wherein each of said inner cutters has cutting blades which slide on a back surface of a corresponding outer cutter, said cutting blades being respectively formed at ends of a plurality of arms which are extended upwardly from a central part of said inner cutter, said cutting blades being inclined in a direction of rotation, and fan blades of said fans being inclined so as to be continuous to said cutting blades of said corresponding inner cutter.

5. An electric razor, according to claim 3, wherein each of said inner cutters has cutting blades which slide on a back surface of a corresponding outer cutter and said cutting blades are formed at ends of a plurality of arms which are extended upwardly from a central part of said inner cutter, said cutting blades being inclined in a direction of rotation, and fan blades of said fans are located between said cutting blades.

6. An electric razor according to claim 5, wherein upper ends of said fan blades of said fans are positioned near a back surface of said outer cutter.

7. An electric razor according to claim 6, further comprising supporting tubes for supporting said outer cutters and said inner cutters and fans are positioned inside said supporting tubes.

* * * * *